United States Patent [19]

Dwivedi et al.

[11] 4,199,374

[45] Apr. 22, 1980

[54] PROCESS OF PREPARING CRYSTALLINE FRUCTOSE FROM HIGH FRUCTOSE CORN SYRUP

[75] Inventors: Basant K. Dwivedi, Randolph; Subodh K. Raniwala, Hoboken, both of N.J.

[73] Assignee: Chimicasa GmbH, Chur, Switzerland

[21] Appl. No.: 972,454

[22] Filed: Dec. 22, 1978

[51] Int. Cl.[2] ..... C13K 11/00

[52] U.S. Cl. ..... 127/60; 127/30; 127/61; 127/62

[58] Field of Search ..... 127/30, 60, 61, 62

[56] References Cited

U.S. PATENT DOCUMENTS

| | | | |
|---|---|---|---|
| 2,588,449 | 3/1952 | Young | 127/30 |
| 3,513,023 | 5/1970 | Kusch | 127/30 X |
| 3,607,392 | 9/1971 | Lauer | 127/30 X |
| 3,684,573 | 8/1972 | Voigt | 127/30 |
| 3,718,484 | 2/1973 | Glabe | 127/30 |
| 3,875,140 | 4/1975 | Barker | 127/30 X |
| 3,883,365 | 5/1975 | Forsberg | 127/30 X |
| 3,928,062 | 12/1975 | Yamauchi | 127/30 X |
| 3,929,503 | 12/1975 | Yamauchi | 127/30 X |

*Primary Examiner*—Sidney Marantz

*Attorney, Agent, or Firm*—Richard P. Crowley

[57] ABSTRACT

A process of preparing free-flowing particles of fructose with or without dextrose, which process comprises: admixing a high fructose corn syrup with ethanol, the corn syrup and ethanol of defined moisture content, to form a clear homogeneous solution; seeding the solution with crystalline fructose and recovering free-flowing particles of crystalline fructose from the seeded solution.

14 Claims, No Drawings

PROCESS OF PREPARING CRYSTALLINE FRUCTOSE FROM HIGH FRUCTOSE CORN SYRUP

BACKGROUND OF THE INVENTION

Corn syrup is typically prepared by the incomplete hydrolysis of starch and generally comprises: a mixture of glucose, maltose and maltodextrans; the hydrolysis of the corn starch to produce the corn syrup is typically effected by the action of acids or enzymes on the corn starch. The primary uses of corn syrup are typically in the food industry where it is employed as a sweetener having a high dextrose equivalent or as a thickener or bodying agent in soft drinks where it is employed with a low dextrose equivalent. Fructose, a naturally occurring sugar, is prepared from corn starch by enzymatic or microbial action. Syrups containing a high concentration of fructose are commercially available. Fructose being a natural sugar, it is desirous to employ the fructose in crystalline form. Therefore, it is desirable to obtain crystalline free-flowing fructose from commercially available high fructose corn syrup compositions.

SUMMARY OF THE INVENTION

This invention concerns the preparation of crystalline fructose from high fructose syrup compositions, particularly corn-syrup compositions, and to the fructose so obtained. In particular this invention relates to a process of preparing free-flowing particles from high fructose corn syrup composition through crystallation and the use of ethanol with the corn syrup and ethanol of defined moisture content.

A process is provided for preparing free-flowing fructose particles from high fructose syrup compositions, such as corn syrup and starch compositions, and which process comprises: providing the syrup composition, typically having a fructose concentration ranging from about 50%–98% by weight, but more typically over 90% by weight of fructose; forming an homogeneous, clear, alcohol solution of the syrup composition with a food-acceptable, volatile alcohol, such as ethanol; seeding the homogeneous, clear, alcohol syrup solution with fine crystals of a polysaccharide, such as, for example, fructose or glucose; and recovering the crystalline fructose from the clear seeded solution. In the process the ratio of syrup composition to the alcohol ranges from about 1-to-2 to 2-to-1, but preferably from 1-to-1 on an equal volume to equal weight basis. It is important in the process of this invention that the moisture content of the syrup and the alcohol is controlled with the moisture of the syrup and alcohol, such that they satisfy the following equation:

$$Q = \frac{WsX_{M1} + WaX_{M2}}{Ws + WaX_{M2}}$$

In accordance with the above equation the "Q" must be less than 0.25 and in the equation "Ws" is the weight of syrup, "Wa" is the weight of alcohol, and "$X_{M1}$" and "$X_{M2}$" are the weight percent of moisture in syrup and alcohol.

The mixture of the high fructose syrup composition with the alcohol should provide for a clear, homogeneous solution. Thereafter, the solution is seeded with a fine-particle size, food-acceptable material, typically another sweetener, such as a polysaccharide and more particularly fine crystalline fructose of glucose and the like. After seeding, the solution may be stirred and then is allowed to stand wherein the fructose crystals are then formed and the crystals are later recovered, harvested by filtration, centrifugation or other crystal-recovering means. The crystals are then washed with an alcohol, such as ethanol, and dried under vacuum. Such crystals as recovered are typically free flowing and have a particle size of less than 400 mesh and typically from less than 200–300 mesh. In one embodiment the seed crystals employed are pure crystalline fructose, such as the crystalline product obtained by the process.

The corn syrup composition employed in the process is typically a commerical syrup composition which is high in fructose, such as a high fructose corn syrup or starch syrup composition, or if desired may be a high fructose composition which is prepared directly employing high fructose. The syrup compositions could have a fructose concentration ranging from about 50%–98%, but for more typically commercial use are over about 90% fructose and may contain varying amounts, such as 3%–8% dextrose and other minor amounts of other polysaccharides.

In the process where the moisture content of the high fructose syrup is too high in that the moisture content of the syrup and the alcohol does not satisfy the equation, then the syrup composition should have the moisture removed simply by concentrating the high fructose syrup composition in a vacuum, for example, at temperatures of about 30° C.–90° C.; i.e., 35° C.–55° C., but typically should be concentrated under vacuum at a temperature at which no color is formed in the concentration. It has been found that in corn syrup compositions which are concentraded under vacuum, a formation of a yellow color typically inhibits and retards the crystallization and recovery of the free-flowing fructose particles.

Any food-acceptable, volatile alcohol may be employed which may be removed easily and which forms a clear, homogeneous solution with the high-fructose syrup concentration and satisfies the moisture contents of the equation, but typically and preferably the alcohol is ethanol, although other alcohols, such as propanol, butanol and similar aliphatic alcohols or even low molecular weight polyhydric alcohols may be employed. The process provides for free-flowing fine crystals of fructose which may be employed directly into edible food compositions, such as into candies, chocolate products, cakes or other food products alone or in combination with other natural or artificial sweeteners. The size of the particular crystal particles may vary and be modified further by various changes in the process conditions, such as the rate of cooling, initial mixing temperatures, amount and type of seeding crystals employed and the like.

In one process, high fructose corn syrup is concentrated in a vacuum at a temperature between 35°–55° C. to a moisture content of $X_{M1}$. This concentrated syrup is mixed with ethyl alcohol of $X_{M2}$ moisture content. The mixture is stirred until a homogeneous and clear solution is obtained, preferably at 30°–55° C. The above mass is seeded with 0.5%–5.0%, for example, 2–3%, of crystalline fructose having a particle size of about 0.05–0.50 mm and then stirred for 5–10 hours. Fine crystals are obtained which grow further when allowed to stand for a longer period of time, for example, 3–12 hours. The crystals are harvested by filtration, centrifugation or other suitable means. These crystals are then washed with alcohol and dried under vacuum.

For the purposes of illustration only the invention will be described in connection with certain embodiments as well as the best mode contemplated by the inventors for carrying out the invention. However, it is recognized that persons skilled in the art may make various changes and modifications in the process, all without departing from the spirit and scope of the invention as described and claimed herein.

EMBODIMENTS OF THE INVENTION

EXAMPLE 1:

High fructose corn syrup with the following composition on a dry matter base was used:

Fructose: 90%

Dextrose: 7%

Other saccharides: 3%

1000 grams of the above syrup at room temperature was mixed with 710 ml, 200-proof alcohol. Contents were well mixed and seeded with 16 grams of crystalline fructose. The resulting mass was allowed to stand for 12 hours. The crystalline mass so obtained was washed with alcohol and dried under vacuum. The yield was 36%. The particle size was smaller than 300 mesh.

EXAMPLE 2:

High fructose corn syrup with the same composition as in Example 1 above was concentrated in vacuum at 40° C. to a solid content of 90°. 1000 grams of this concentrated syrup (50° C.) was mixed with 558 ml, 190-proof ethyl alcohol at room temperature. The resulting mass was seeded with 18 grams of crystalline fructose, stirred and allowed to cool. After 15 hours, the crystalline mass was filtered, washed and dried under vacuum. The yield was about 50% and the particle size was from 200–400 mesh.

What we claim is:

1. A process for preparing free-flowing fructose particles from a high-fructose syrup composition, which process comprises:

(a) providing a high fructose syrup composition having a fructose concentration of from about 50 to about 98% by weight;

(b) admixing the syrup composition with a foodacceptable, volatile alcohol to provide a homogeneous, clear, alcohol syrup solution with the ratio of the syrup composition to alcohol ranging from about 1-to-2 to 2-to-1 on a volume to weight basis, the moisture content of the syrup and the alcohol being such that Q is less than 0.25 in the equation:

$$Q = \frac{WsX_{M1} + WaX_{M2}}{Ws + WaX_{M2}}$$

wherein (i) Ws is the weight of syrup;

(ii) Wa is the weight of alcohol;

(iii) $X_{M1}$ and $X_{M2}$ are the weight percent of moisture in syrup and alcohol;

(c) seeding the solution with fine saccharide particles and allowing the seeded solution to stand to provide crystallization of the fructose from the seeded solution; and (d) recovering free-flowing fructose particles having a mesh size of less than about 400 mesh.

2. The process of claim 1 wherein the syrup composition comprises a corn syrup composition having over about 90% fructose.

3. The process of claim 1 wherein the volatile alcohol comprises ethyl alcohol.

4. The process of claim 1 wherein the ratio of syrup solution to alcohol is about 1-to-1.

5. The process of claim 1 which includes: seeding the clear, homogeneous alcohol syrup solution with about 0.5% to 5% by weight of crystalline fructose or glucose.

6. The process of claim 1 which includes: recovering the crystalline fructose from the solution; washing with alcohol; and drying the crystalline fructose under vacuum to provide a free-flowing crystalline fructose.

7. The process of claim 1 which includes: stirring the clear, homogeneous mixture after the addition of the crystalline polysaccharide; and allowing the stirred mixture then to stand for a period of time of about 3–12 hours prior to recovering the fructose.

8. The process of claim 1 wherein the fine polysaccharide particles have a particle size of from about 0.05 to 0.50 mm.

9. The process of claim 1 which includes seeding the solution with from about 0.5 to 5.0 percent by weight of crystalline fructose having a particle size of about 0.05 to 0.50 mm and stirring the seeded solution for about 5 to 10 hours.

10. A process of preparing free-flowing fructose particles from a high fructose corn syrup composition, which process comprises:

(a) providing a high fructose corn syrup composition having a fructose concentration of over about 90% by weight;

(b) admixing the corn syrup high-fructose composition with ethanol to provide a homogeneous, clear ethanol corn syrup solution with the ratio of the corn syrup composition to the ethanol between equal volume to equal weight, the moisture content of the corn syrup and ethanol being such that Q is less than 0.25 in the equation:

$$Q = \frac{WsX_{M1} + WaX_{M2}}{Ws + WaX_{M2}}$$

wherein (i) Ws is the weight of syrup;

(ii) Ws is the weight of alcohol; and (iii) $X_{M1}$ and $X_{M2}$ are the weight percent of moisture in syrup and alcohol;

(c) seeding the homogeneous solution with fine particles of crystalline fructose or glucose and allowing the mixture to stand to provide crystallization of the fructose from the clear solution; and (d) harvesting the crystalline fructose from the solution, washing the harvested crystals with alcohol and drying the crystals so recovered under vacuum to provide free-flowing fructose particles having a particle size of less than about 400 mesh.

11. The process of claim 10 wherein the clear, homogeneous solution is seeded with crystalline fructose obtained from the same process.

12. The process of claim 10 which includes concentrating a corn syrup composition under vacuum to remove moisture to the desired moisture level and at a temperature at which no yellow color is formed in the corn syrup composition.

13. The process of claim 10 which includes seeding the solution with from about 0.5 to 5.0 percent by weight of crystalline fructose having a particle size of about 0.05 to 0.50 mm.

14. The process of claim 10 which includes stirring the seeded solution for about 5 to 10 hours and, thereafter, allowing the solution to stand for 3 to 12 hours.

* * * * *

UNITED STATES PATENT OFFICE

CERTIFICATE OF CORRECTION

PATENT NO. : 4,199,374

DATED : April 22, 1980

INVENTOR(S) : Basant K. Dwivedi et al

It is certified that error appears in the above-identified patent and that said Letters Patent are hereby corrected as shown below:

In column 3, claim 1, (c), line 60, delete the word "saccharide" and insert --polysaccharide--.

In column 4, claim 10 (b) (ii), line 43, delete the word "Ws" and insert --Wa--.

Signed and Sealed this

*Twenty-second* Day of *July 1980*

[SEAL]

*Attest:*

SIDNEY A. DIAMOND

*Attesting Officer*

*Commissioner of Patents and Trademarks*